US006574871B1

(12) United States Patent
Visconti et al.

(10) Patent No.: US 6,574,871 B1
(45) Date of Patent: Jun. 10, 2003

(54) TWO-PIECE LETTER OPENER

(76) Inventors: Frank J. Visconti, 1301 Parkview Meadows Dr., St. Louis, MO (US) 63103; David P. Lage, 8 Saybridge Ct., Manchester, MO (US) 63011

( * ) Notice: Subject to any disclaimer, the term of this patent is extended or adjusted under 35 U.S.C. 154(b) by 0 days.

(21) Appl. No.: 09/470,473

(22) Filed: Dec. 22, 1999

(51) Int. Cl.[7] ..... B26B 29/00
(52) U.S. Cl. ..... 30/294; 30/DIG. 3
(58) Field of Search ..... D8/102, 103, 104; 30/DIG. 3, 340, 342, 344, 280, 294; 40/446

(56) References Cited

U.S. PATENT DOCUMENTS

| | | | | | |
|---|---|---|---|---|---|
| 1,464,367 | A | * | 8/1923 | Krzyewski | 30/164 |
| 1,519,816 | A | * | 12/1924 | Ward | 30/298 |
| 2,439,639 | A | * | 4/1948 | Tilly | 30/289 |
| 2,535,555 | A | * | 12/1950 | Tilly | 30/125 |
| 2,682,123 | A | * | 6/1954 | Frederickson | 40/331 |
| 2,748,478 | A | * | 6/1956 | Shelton | |
| 2,750,668 | A | * | 6/1956 | Tarrazi | |
| 2,775,034 | A | * | 12/1956 | Bulecki | 30/294 |
| D306,394 | S | | 3/1990 | Koenig | |
| D329,183 | S | | 9/1992 | Lage | |
| D329,184 | S | | 9/1992 | Lage | |
| D341,307 | S | | 11/1993 | Lage | |
| D342,008 | S | * | 12/1993 | Lage et al. | |
| 5,285,577 | A | * | 2/1994 | Carney et al. | |
| D350,770 | S | | 9/1994 | Carney | |
| D354,214 | S | | 1/1995 | Lage | |
| D355,108 | S | | 2/1995 | Lage | |
| D364,547 | S | | 11/1995 | Lage | |
| D365,267 | S | | 12/1995 | Goessling | |
| D368,010 | S | | 3/1996 | Lage | |
| D387,967 | S | | 12/1997 | Visconti | |
| 5,819,419 | A | * | 10/1998 | Schmidt | |

* cited by examiner

*Primary Examiner*—Kenneth E. Peterson
(74) *Attorney, Agent, or Firm*—Polster, Lieder, Woodruff & Lucchesi, L.C.

(57) ABSTRACT

A slitter-type envelope opener has two portions which are manufactured separately and later joined together—namely, a cutting portion and a handle portion. The cutting portion has a molded base, a spear and a connecting segment joining the base and spear such that a slot exists between them. At its one end the slot is open, while the other end is closed at the connecting segment. Here the cutting portion is provided with a blade that is embedded in the spear and connecting segment. The handle portion has a molded base and a gripping portion, with the gripping portion being configured in a desired shape and perhaps sculpted in relief. The bases of the two portions have rabbets, with the base of the handle portion fitting into the rabbet in the base in the cutting portion and the base of the cutting portion fitting into the rabbet in the base of the handle portion. Here the two portions are joined permanently together.

7 Claims, 2 Drawing Sheets

TWO-PIECE LETTER OPENER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates in general to envelope openers and, more particularly, to a slitter-type envelope opener having its handle portion and slitting portion formed as separate components and to a process for making the same.

Slitter-type envelope openers open envelopes with considerable ease, are quite compact and are produced inexpensively. They find widespread use in offices throughout the country. The typical opener of this type has a handle which enables one to grip the device and a finger or spear that is located below the handle. Between the handle and spear lies a slot, and at the end of the slot, a blade. The spear is small enough to fit behind the fold of a flap for an envelope and the slot is large enough to accommodate the fold. Thus one, while gripping the opener along its handle, manipulates the spear beneath the flap and then advances it behind the fold. After short distance the blade encounters the fold and slits the envelope along the fold as the device is advanced.

Many businesses give the openers away as promotional items, with the handles usually bearing the trademark of the business and perhaps some advertising message as well. Some manufacturers of these openers have configured the handles to identify with specific businesses. For example, the handle may resemble a house, and openers having such handles would appeal to real estate companies for use as promotional items. The handles of others may resemble trucks and, of course, would appeal to trucking companies. U.S. Pat. Des. 329,184, Des. 341,307, Des. 342,008, Des. 354,214, Des. 355,108, Des. 368,010, and Des. 364,547 illustrate openers having handles configured for specific types of businesses.

Most manufacturers of letter openers offer only a few shapes and, rarely, customize an opener for any customer. After all, the mold for producing any opener is costly, with much of the cost being attributable to the region of the mold in which the slitting portion of the opener is formed, that is the portion with the spear and the embedded blade, for that portion has shapes more complex than the handle portion.

SUMMARY OF THE INVENTION

The present invention resides in an opener having a handle portion and a slitting or cutting portion which are formed separately and thereafter joined together. The invention also resides in the method of making the opener, that is to say, forming its handle and cutting portions separately and then joining them together.

DETAILED DESCRIPTION

Figure 1:
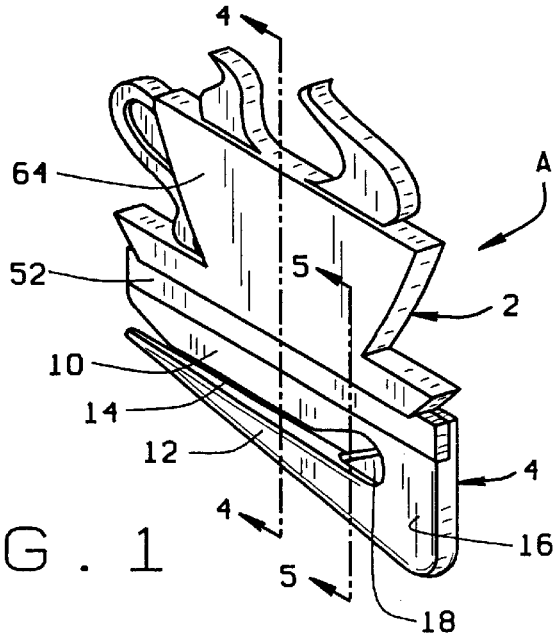
FIG. 1 is a perspective view of an envelope opener constructed in accordance with and embodying the present invention.

Referring now to the drawings, an envelope opener A (FIG. 1) of the slitter variety possesses two components, basically, a handle portion 2 and a cutting portion 4. The portions 2 and 4 are manufactured separately and are then joined together permanently. Preferably the two portions 2 and 4 are injection molded from a suitable polymer such as ABS plastic.

Figure 2:
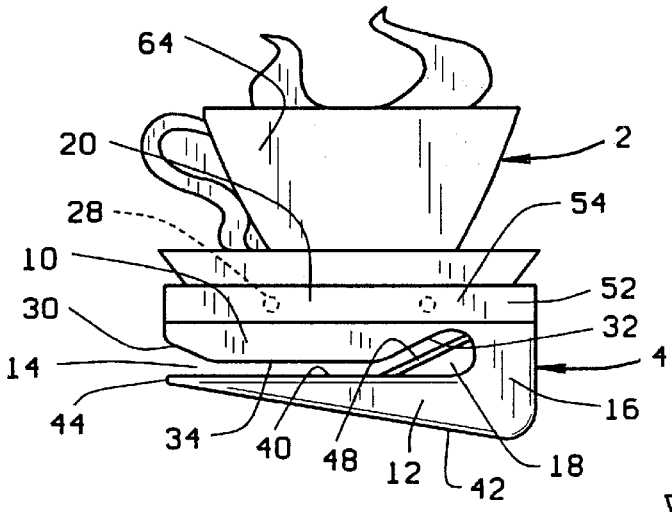
FIG. 2 is a front view of the opener, with its handle and cutting portions united.
Figure 3:
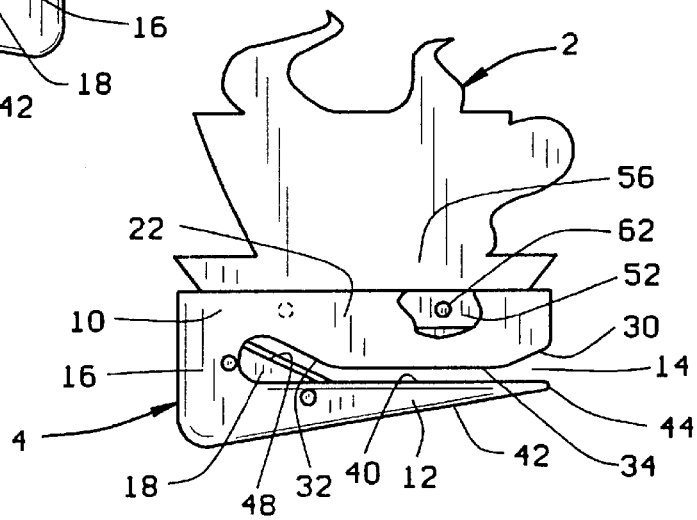
FIG. 3 is a rear view of the opener, partially broken away to show a boss on the base of the handle portion.

Considering the cutting portion 4 first, it includes (FIGS. 2, 3 & 6) a base 10, a spear 12 that is separated from the base 10 by a slot 14, and a connecting segment 16 which is formed integral with the base 10 and the spear 12 at one end of the slot 14 to support the spear 12 on the base 10. One end of the slot 14 is open, while the other end is closed by the connecting segment 16. The cutting portion 4 also includes a blade 18 which is embedded in the spear 12 and connecting segment 16 where it is exposed at the closed end of the slot 14.

The base 10 of the cutting portion 4 has a front face 20 and a back face 22 as well as a straight upper margin 24 to which the back face 22 extends. Along the margin 24 the base 10 contains a rabbet 26 which opens out of the front face 20. Here the base 10 possesses less thickness than it does elsewhere, or in other words, the thickness of the base 10 at the rabbet 26 is less than the distance between the front and back faces 20 and 22. Moreover, the base 10 at the rabbet 26 has two cylindrical depressions or indentations 28 (FIG. 6) which open into the rabbet 26.

Along the slot 14, the base 10 has beveled end margins 30 and 32 and between them an intervening margin 34 of somewhat greater length. The end margin 30 lies at the open end of the slot 14 where it provides a wide entry into the slot 14. The other end margin 32 is at the closed end of the slot 14. The intervening margin 34 lies generally parallel to the spear 12.

The spear 12 has a straight inner margin 40 and a straight outer margin 42 which converge to a slightly blunted point 44 located at the open end of the slot 14. The inner margin 40 lies parallel to the upper margin 24 and the intervening margin 34 of the base 10, and this, of course, presents the outer margin 42 farther from the upper margin 24 at the connecting segment 16 than at the blunted point 44.

The connecting segment 16 is formed integral with the base 10 and with the spear 12 and presents the spear 12 in a generally fixed position with respect to the base 10. Indeed, it supports the spear 12 on the base 10.

The blade 18, in contrast to the base 10, spear 12 and connecting segment 16, is formed from metal. It lies midway between the front and rear faces of the spear 12 and the connecting segment 16, with much of it being embedded in the polymer of the spear 12 and the connecting segment 16. Indeed, in the manufacture of the cutting portion 4 the polymer is molded around much of the metal blade 18. But the blade 18 remains exposed at the closed end of the slot 14, and here it has a beveled cutting edge 48 which lies generally parallel to the inner beveled margin 32 of the base 10. The edge 48 extends from the inside margin of the connecting segment 16 to the straight inner margin 42 of the spear 12.

The cutting portion 4 is injection molded from a suitable polymer in a mold of some complexity owing to its relatively intricate configuration and the presence of the blade 18. The mold is formed from steel and may have several cavities.

The handle portion 2 likewise has (FIGS. 2, 3 & 6) a base 52 provided with a front face 54 and a back face 56, as well as a straight lower margin 58 along the bottom of the front face 54. At its base 54, the handle portion 2 is as thick as the cutting portion 4 is at its base 10. That is to say, the distance between the front and back faces 54 and 56 on the base 52 for the handle portion 2 equals the distance between the front and back faces 20 and 22 on the base 10 of the cutting portion 4. The base 52 of the handle portion 2 along its lower margin 58 contains a rabbet 60 which opens out of the back face 58. At the rabbet 60 the thickness of the base 52 is less than the distance between the front and back faces 54 and 56. The height of the rabbet 60 corresponds to the height of the rabbet 26 in the base 10 of the cutting portion 2. The base 52 of the handle portion 2 also has bosses 62 which project outwardly from the bottom of the rabbet 60. In size and position, the bosses 62 correspond to the cylindrical indentations 28 in the base 10 of the cutting portion 4.

Above the base 10, the handle portion 62 has a gripping segment 64, which may assume any of various configurations appropriate for the distributor or user of the envelope opener. For example, if the distributor of the letter opener A deals in coffee or perhaps operates a coffee house, the gripping segment 64 may resemble a coffee cup. On the other hand, one who deals in farm supplies may want an opener A in which the gripping segment 64 resembles a pig. In any event, the back face 56 of the base 52 may continue through the gripping segment 64, so that the back of the gripping segment 64 beyond the rabbet 60 is planar. But the front of the gripping segment 64 may be raised beyond the front face 54 of the base 52 and sculpted in relief. The front or the back of the gripping segment 64 or both may carry the trademark of the distributor of the opener A or an advertising message.

The handle portion 2 is injection molded from a suitable polymer in a relatively simple mold. Where few handle portions 2 of a particular configuration are needed, the mold may be machined from aluminum at relatively modest expense.

Figure 5:
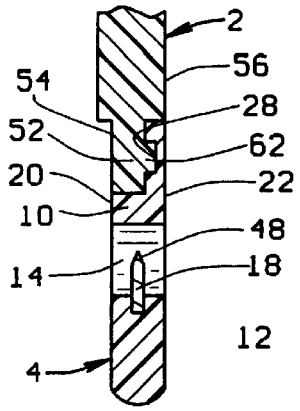
FIG. 5 is a sectional view taken along line 5—5 of FIG. 1.
Figure 4:
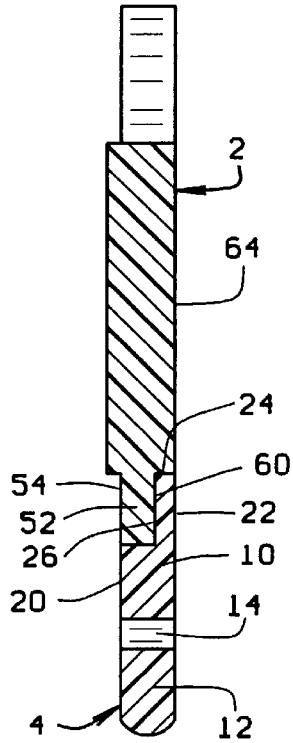
FIG. 4 is a sectional view taken along line 4—4 of FIG. 1.
Figure 6:
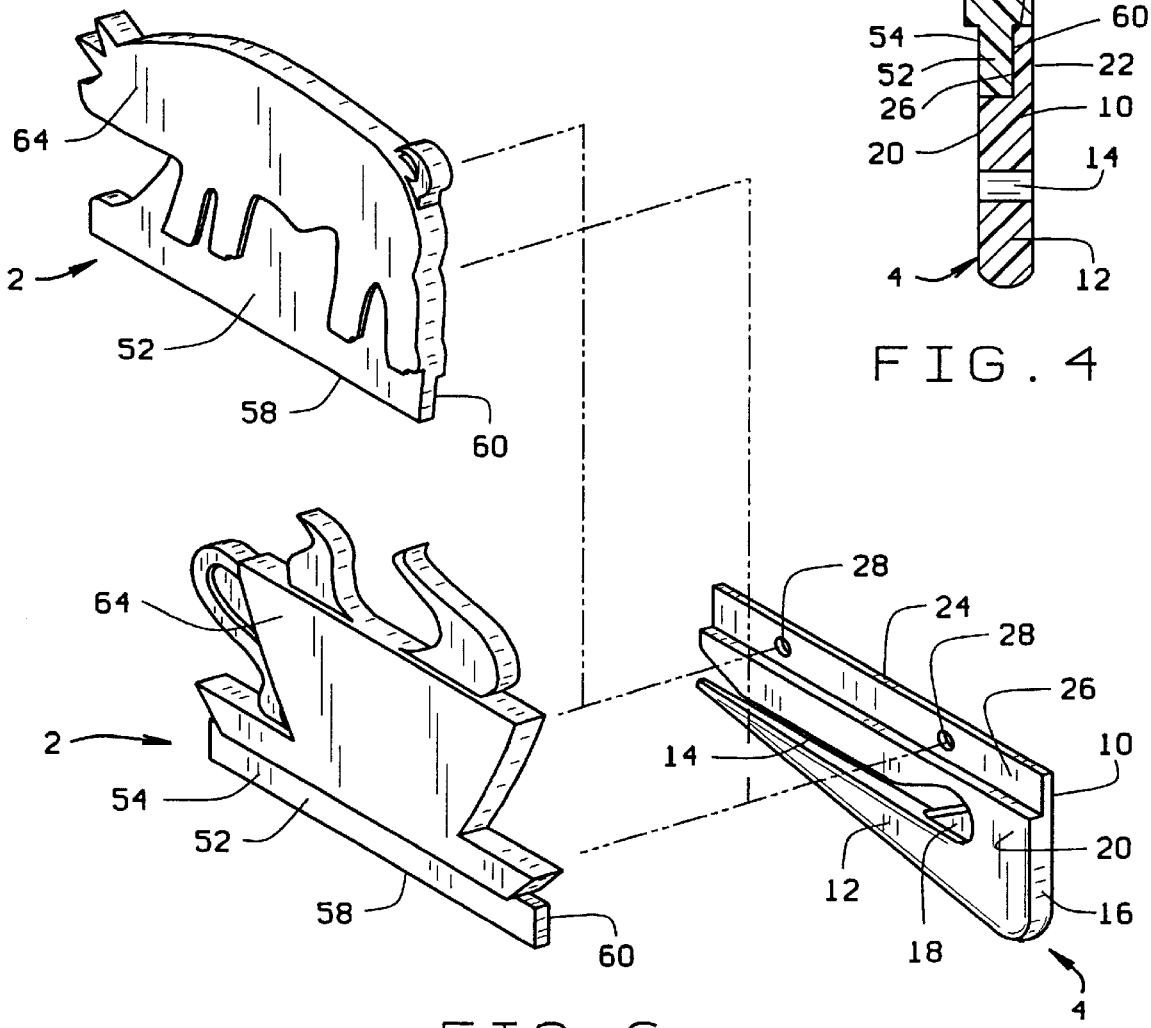
FIG. 6 is a perspective view of the two different handle portions and a single cutting portion, all separated.

To assemble the letter opener A, one selects a handle portion 2 having a gripping segment 64 of desired configuration. One also obtains a cutting portion 4. The handle portion 2 and cutting portion 4 are brought together such that bosses 62 on the handle portion 2 align with the indentations 28 in the cutting portion 4 (FIG. 6). The rabbet 60 in the base 52 for the handle portion 2 receives the rabbeted segment of the base 10 for the cutting portion 4, and likewise the rabbet 26 in the cutting portion 4 receives the rabbeted segment of the base 52 for the handle portion 2 (FIG. 4) . Moreover, the bosses 62 in the rabbeted segment of the base 52 for the handle portion 2 fit into the indentations 28 in the rabbeted segment of the base 10 for the cutting portion 4 (FIG. 5). Indeed, the bosses 62 and indentations 28 into which they fit serve to properly position the handle portion 2 on the cutting portion 4. Thereupon, the two portions 2 and 4, while being clamped tightly together at their bases 52 and 10, are ultrasonically welded. The polymers of the two portions 2 and 4, at their respective bases 52 and 10, diffuse into each other to firmly bond the handle portion 2 to the cutting portion 4. When the handle and cutting portions 2 and 4 are bonded together, the front face 20 on the base 10 of the cutting portion 4 lies flush with the front face 54 on the base 52 of the handle portion 2 (FIGS. 4 & 5). Likewise, the back face 22 on the base 10 of the cutting portion 4 lies flush with the back face 56 in the base 52 of the handle portion 2. Other procedures may be used to join the handle portion 2 and cutting portion 4. For example, the two portions 2 and 4 may be joined at their rabbets 26 and 60 with glue. Or a rivet may be extended through the two portions 2 and 4 at their rabbets 26 and 60.

In order to open an envelope with the opener A, one grasps the opener A along the gripping segment 64 of its handle portion 2. Then the spear 12 of the cutting portion 4 is aligned with the end of the envelope and inserted between the flap and the front panel of the envelope at the fold joining the flap to the front panel. Thereupon the user advances the handle portion 2 over the fold of the flap, and this moves the spear 12 under the fold. After a short distance the cutting edge 48 of the blade 18 reaches the end of the fold and as the opener A continues to advance, the blade 18 cuts the envelope along the fold of its flap.

What is claimed is:

1. An envelope opener comprising: a cutting portion including a base having front and back faces and provided with a rabbet opening out of one of its faces, a spear spaced from the base, and a connecting segment extending between the base and one end of the spear to support the spear on the base, there being a slot between the base and the spear, with both sides and one end of the slot being open and the other end being closed at the connecting segment, the base, spear and connecting segment being molded as an integral unit from a polymer, the cutting portion also including a blade which is embedded in the spear and the connecting segment and presents a cutting edge at the closed end of the slot; and a handle portion including a base having front and back faces and provided with a rabbet opening out of one of its faces, the handle portion also including a gripping segment joined to its base and having a front and a back where it is exposed for griping, the base and gripping segment also being molded as an integral unit from a polymer; the base of the handle portion being received in the rabbet of the base for the cutting portion and the base of the cutting portion being received in the rabbet of the base for the handle portion, with the front faces of the two bases being flush and the back faces at the two bases being flush, the cutting portion and the handle portion being joined firmly together at their bases.

2. An envelope opener according to claim 1 wherein one of the bases has indentations and the other base has bosses which fit into the indentations and serve to position the portions with respect to each other.

3. An envelope opener according to claim 1 wherein the cutting portion and the handle portion are permanently joined together at their bases.

4. An envelope opener comprising: a cutting portion including a spear and a connecting segment located at one end of the spear, there being a slot located along the spear and leading toward the connecting segment, with one end and both sides of the slot being open, the cutting portion also including a base which is connected to the connecting segment and extends along the slot, the cutting portion further including a blade embedded in the spear and the connecting segment and having a cutting edge presented toward the open end of the slot; and a handle portion formed separate and apart from the cutting portion and lying beyond the slot that extends along the spear, the handle portion including a base and a gripping segment connected to the base, the base of the cutting portion having a rabbet in which the base of the handle portion is received and the base of the handle portion having a rabbet in which the base of the cutting portion is received, the bases of the cutting and handle portions have front and back faces, with the front faces of the bases being flush and the back faces of the bases being flush, the cutting portion and the handle portion being permanently joined together at their bases.

5. An envelope opener according to claim 4 wherein the base, spear and connecting segment of the cutting portion are molded as an integral unit from a polymer, and the base and gripping segment of the handle portion are molded as an integral unit from a polymer.

6. An envelope opener according to claim 4 wherein the front of the gripping segment for the handle portion is sculpted in relief.

7. An envelope opener according to claim 4 wherein the cutting portion and handle portion are bonded together.

* * * * *